US006139206A

United States Patent [19]

Ahn

[11] Patent Number: 6,139,206

[45] **Date of Patent: *Oct. 31, 2000**

[54] MULTIFUNCTIONAL MACHINE PERFORMING A SHUTTLE-SCANNING

[75] Inventor: Byung-Sun Ahn, Suwon, Rep. of Korea

[73] Assignee: SamSung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,364

[22] Filed: Nov. 4, 1997

[30] Foreign Application Priority Data

Nov. 4, 1996 [KR] Rep. of Korea ..... 96/51893
Nov. 4, 1996 [KR] Rep. of Korea ..... 96/51894

[51] Int. Cl.[7] ..... B41J 19/30

[52] U.S. Cl. ..... 400/323; 400/82; 347/3

[58] Field of Search ..... 400/73, 82, 88, 400/188, 124.08, 124.11, 175, 323; 358/401, 404, 474; 347/3, 4, 104, 129, 133

[56] References Cited

U.S. PATENT DOCUMENTS

| | | | |
|---|---|---|---|
| D. 296,788 | 7/1988 | Schneider et al. . | |
| D. 339,372 | 9/1993 | Kanda . | |
| D. 363,924 | 11/1995 | Ueda et al. . | |
| D. 368,259 | 3/1996 | Bishop et al. . | |
| D. 373,763 | 9/1996 | Daley . | |
| 3,502,814 | 3/1970 | Salaman et al. . | |
| 4,321,627 | 3/1982 | Hooker, III . | |
| 4,620,233 | 10/1986 | Ogawa et al. | 358/260 |
| 4,700,238 | 10/1987 | Sugiyama | 347/3 |
| 4,839,741 | 6/1989 | Wilson . | |
| 5,038,228 | 8/1991 | Takada . | |
| 5,083,766 | 1/1992 | Osawa | 271/121 |
| 5,107,100 | 4/1992 | Shepard et al. . | |
| 5,278,396 | 1/1994 | McGaha . | |
| 5,365,364 | 11/1994 | Taylor . | |
| 5,369,480 | 11/1994 | Isobe | 358/401 |
| 5,412,490 | 5/1995 | Kojima et al. . | |
| 5,544,045 | 8/1996 | Garland et al. . | |
| 5,557,707 | 9/1996 | Inoue et al. . | |
| 5,624,194 | 4/1997 | Matsuzawa . | |

FOREIGN PATENT DOCUMENTS

| | | | |
|---|---|---|---|
| 54-10730 | 1/1979 | Japan | 358/474 |
| 55-105472 | 8/1980 | Japan | 358/474 |
| 60-141072 | 7/1985 | Japan | 358/474 |
| 60-141073 | 7/1985 | Japan | 358/474 |
| 61-192572 | 8/1986 | Japan | 400/188 |
| 62-113571 | 5/1987 | Japan | 400/188 |
| 3-36054 | 2/1991 | Japan | 400/188 |

*Primary Examiner*—Ren Yan
*Attorney, Agent, or Firm*—Robert E. Bushnell, Esq.

[57] ABSTRACT

Disclosed is a multifunctional machine which prevents the contamination caused by the contact of a document and a printhead, by placing the printhead to face a base frame supporting a printable medium and placing a scanner to face the base frame supporting the document. Also, disclosed is a multifunctional machine capable of simplifying the structure and reducing the manufacturing costs, by sharing the base frame for supporting the printable medium and the document and by moving the printhead and the scanner using one driving motor.

17 Claims, 4 Drawing Sheets

MULTIFUNCTIONAL MACHINE PERFORMING A SHUTTLE-SCANNING

CLAIM OF PRIORITY

This application makes reference to, incorporates the same herein, and claims all benefits accruing under 35 U.S.C. §119 from an application entitled *Multifunctional Machine Performing A Shuttle-Scanning* earlier filed in the Korean Industrial Property Office on Nov. 4, 1996, and there duly assigned Serial No.96-51893 and No.96-51894 by that Office.

BACKGROUND OF THE INVENTION

1. Field of the Invention

The present invention relates to a multifunctional machine, and particularly to a multifunctional machine which prevents the contamination caused by the contact of a document and a printhead, by placing the printhead to face a base frame supporting a printable medium and placing a scanner to face the base frame supporting the document.

Further, the present invention relates to a multifunctional machine capable of simplifying the structure and reducing the manufacturing costs, by sharing the base frame for supporting the printable medium and the document and by moving the printhead and the scanner using one driving motor.

2. Description of the Related Art

First, a printable medium, which is referred to in the specification indicates a medium capable of recording a predetermined information such as a printing paper.

Nowadays, office automation facilities such as a printer, a scanner, a duplicator, a facsimile, etc. have become widespread. To extend their own functions, these office automation facilities each having high efficiency have been developed. Accordingly, the manufacturing costs of the products increase and this may impose an economic burden on users. To solve the problem, by integrating the office automation facilities which have separately been used into a multifunctional device, the economic burden on users can be lessened.

Conventionally, the multifunctional machine includes a document scanning unit and a printing unit which separately perform the scanning and printing operations.

The multifunctional machine has a same path for transporting the document and the printable medium, and an image scanning sensor which is integrated at a high density is separately mounted at a printhead carriage housing. When scanning the document, an ink-jet printhead and the image scanning sensor perform the reciprocation on the document perpendicular to the document transporting direction, by means of a carriage motor along a carriage shaft. At this time, the image scanning sensor scans data from the document. After the scanning is completed once, the document is transported as much as a predetermined length by a document transporting motor. By repeatedly performing the above-described process, the document scanning is completed.

In the case of the multifunctional machine in which the image scanning sensor is attached to the printhead carriage housing, as the ink-jet printhead and the image scanning sensor move together, the surface of the document is always contacted with an ink injection unit of the printhead. As a result, when performing the scanning operation, as the ink is spread on the surface of the document due to the contact of the ink injection unit of the printhead and the surface of the document the image on the document can be damaged.

In the case that the interval between the printhead and the printable medium is larger than the interval between the image scanning sensor and the document, the ink injected on the printable medium which is not yet dry is contacted with the surface of the image scanning sensor, thereby causing a poor image quality.

Moreover, when picking up the document, as the surface of the document is contaminated by a pickup roller caused by the friction between the surface of the document and the pickup roller, the data on the document can be damaged.

To solve the above problems, a multifunctional machine which has two different paths for transporting the document and the printable medium, and drives the printhead and the image scanning sensor by means of different driving sources has been presented. However, as the separate driving sources are used to drive the printhead and the image scanning sensor and also to transport the printable medium and the document, the manufacturing cost increases and the space for setting up the machine becomes large.

SUMMARY OF THE INVENTION

Therefore, it is an object of the present invention to provide a multifunctional machine which prevents the image on the document from being damaged by a pickup roller and a printhead when scanning and prevents the deterioration of the printed image by an image scanning sensor when printing, the printhead and the image scanning sensor being perpendicular to the document or the transporting direction and simultaneously separated from each other by as much as a predetermined distance respectively perpendicular to the reciprocating direction.

It is another object of the present invention to provide a multifunctional machine in which the printhead and the image scanning sensor are perpendicular to the document or the transporting direction and simultaneously separated from each other by as much as a predetermined distance respectively perpendicular to the reciprocating direction, which reduces the manufacturing costs by simplifying the structure and reduces the volume of the product, by driving the printhead and the image scanning sensor by means of one driving unit and transporting the document and printable medium by means of one transporting motor.

According to one aspect of the present invention, a scanning unit scans the document by reciprocating perpendicular to the document transporting direction; a printing unit prints on the printable medium by reciprocating perpendicular to the printable medium transporting direction and the printing unit and the scanning unit are separated from each other by as much as a predetermined direction respectively perpendicular to the reciprocating direction.

In one preferred embodiment, the printing unit and the scanning unit are respectively opposite to each other and a path for transporting the document and the printable medium is formed therebetween.

In another preferred embodiment, the printing unit and the scanning unit are formed to be in the same direction and the paths for transporting the document and the printable medium are respectively oppositely formed on the scanning unit and the printing unit.

Preferably, the printing unit and the scanning unit are simultaneously driven by one driving source. A scanning unit scans the document on the base frame by reciprocating perpendicular to the document transporting direction; and a printing unit is located opposite to the scanning unit centering around the base frame and prints on the printable medium on the base frame by reciprocating perpendicular to the printable medium transporting direction.

According to the present invention, the printing unit and the scanning unit are simultaneously driven by one driving source and receive a driving force from the driving source through a belt.

Preferably, on the base frame, a slot having a length corresponding to the width where the scanning unit performs reciprocation is formed. A protection plate of transparent material is preferably inserted into the slot.

According to the present invention, a first guide shaft for guiding the reciprocation of the scanning unit is provided to equally maintain the interval between the scanning unit and the document and between the printing unit and the printable medium; and a second guide shaft for guiding the reciprocation of the printing unit and located parallel to the first guide shaft is provided.

Moreover, the scanning unit and the printing unit reciprocate in a same direction and they are separated from each other as much as a predetermined distance perpendicular to the transporting direction. Or, the scanning unit and the printing unit reciprocate in opposite directions and they are separated from each other as much as the width where the reciprocation is performed.

The scanning unit and the printing unit can be driven by separate driving sources. At this time, the moving speeds of the scanning unit and the printing unit can be the same or different.

According to another aspect of the present invention, paths for transporting the document and the printable medium are different. A first base frame located at the path for transporting the printable medium supports the printable medium, and a second base frame located at the path for transporting the document supports the document. The printing unit is located at the upper part of the first base frame and performs the printing operation on the printable medium by the reciprocation on the printable medium, and the scanning unit is located at the upper part of the second base frame and scans the document by the reciprocation perpendicular to the document transporting direction. Here, the scanning unit and the printing units are separately or simultaneously driven by means of a same driving source.

Preferably, the scanning unit and the printing unit receive the driving force from the driving source through a belt.

According to the present invention, a power unit for transporting is further included for providing power to transport the document and the printable medium separately or simultaneously. Preferably, the power unit for transporting includes a transporting motor; a decelerating gear for decelerating the driving force generated by the transporting motor; driving units for transporting the document and the printable medium which transmits the decelerated driving force to a document transporting roller and a printable medium transporting roller, respectively; and power switching devices for transporting the document and the printable medium which control the delivery of the driving force to the document transporting roller and the printable medium transporting roller in accordance with the control of the driving units for transporting the document and the printable medium.

According to another aspect of the present invention, the first base frame supports the printable medium and the second base frame supports the document. The printing unit is located to face the first base frame and prints data on the printable medium by performing the reciprocation on the printable medium, and the scanning unit is located to face the second base frame and scans the document by performing the reciprocation on the document perpendicular to the document transporting direction. The driving force generated by a driving force generating unit transmits the driving force to the printing unit and the scanning unit through first and second driving force transmitting units. The driving force generating unit is connected to one of the first and second driving force transmitting units and drives the printing unit and the scanning units, separately or simultaneously.

Preferably, the first driving force transmitting unit includes a driving pulley connected to the driving force generating unit and a first driven pulley connected to the driving pulley by means of a first belt to which the printing unit is connected. Moreover, the second driving force transmitting unit includes a second driven pulley connected to the driving pulley by means of a second belt and a third driven pulley connected to the second driven pulley by means of a third belt to which the scanning unit is connected.

Preferably, the driving force generating unit includes a stepping motor.

Selectively, the first base frame and the second base frame can be shared as a common base frame and it is possible to form a same path for transporting the document and the printable medium. In the case, the printing unit can be located at the upper part of the common base frame, and the scanning unit can be located at the lower part of the common base frame, facing each other.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIGS. 2A and 2B are front sectional views illustrating the first embodiment of a multifunctional machine performing the shuttle scanning according to the present invention; in which, FIG. 2A is a view illustrating the case where the distance between the scanning unit and the printing unit is short when the reciprocation is performed; and FIG. 2B is a view illustrating the case where the distance between the scanning unit and the printing unit is long when the reciprocation is performed;

DETAILED DESCRIPTION OF THE PREFERRED EMBODIMENTS

The objects, characteristics and advantages of the above-described invention will be more clearly understood through the preferable embodiments referring to the attached drawings.

As the terms mentioned later are determined based upon the function of the present invention, and they can be changed according to the technician's intention or a usual practice, the terms should be determined considering the overall contents of the specification of the present invention.

Figure 1:
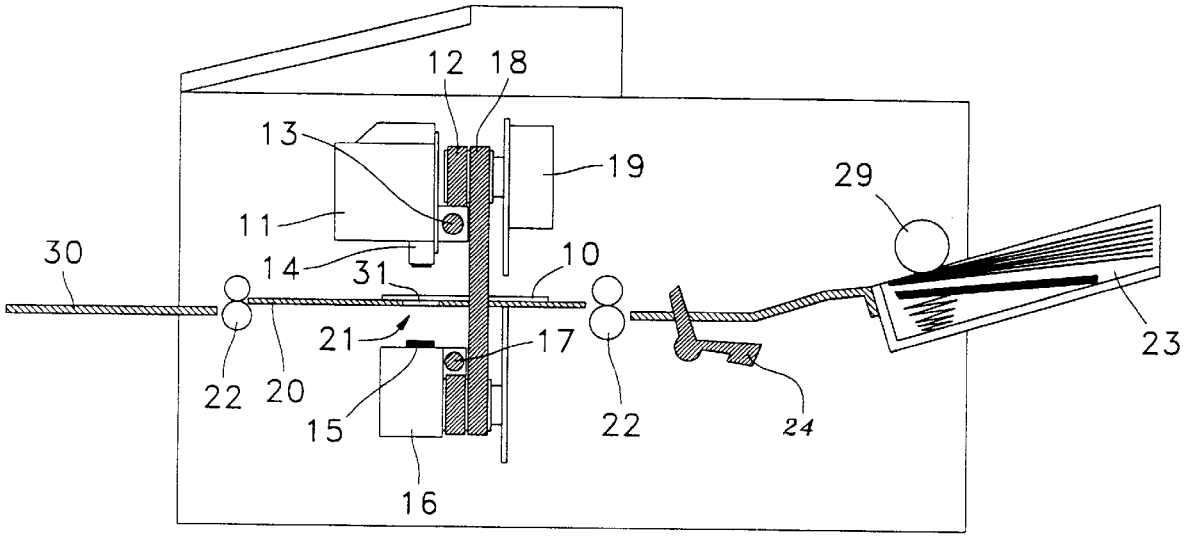
FIG. 1 is a side sectional view illustrating a first embodiment of a multifunctional machine performing the shuttle scanning according to the present intention.
Figure 4:
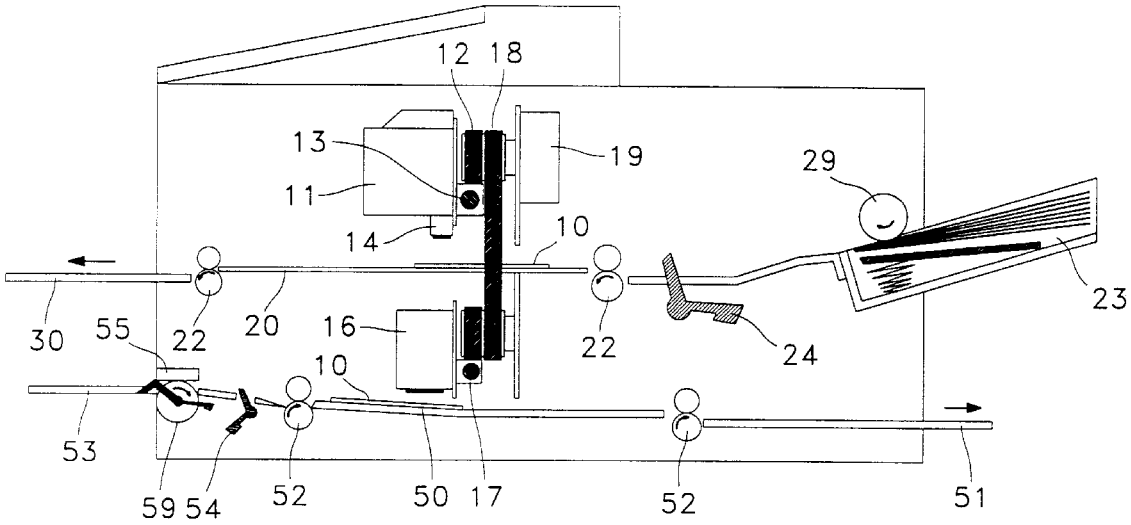
FIG. 4 is a side sectional view illustrating a second embodiment of the multifunctional machine performing the shuttle scanning according to the present invention.

Preferred embodiments of the present invention are respectively shown in FIGS. 1 and 4. The common structure of the present invention will be described hereinafter. A scanning unit 16 scans a document 10 by reciprocating perpendicular to the document transporting direction; a printing unit 11 prints on the printable medium 10 by reciprocating perpendicular to the printable medium transporting direction and the printing unit 11 and the scanning unit 16 are separated from each other by as much as a predetermined direction respectively perpendicular to the reciprocating direction and the transporting direction.

According to FIG. 1, the printing unit 11 and the scanning unit 16 are respectively opposite to each other and a path for transporting the document and the printable medium 10 is formed therebetween.

According to the FIG. 4, the printing unit 11 and the scanning unit 16 are formed to the same direction and the path for transporting the document and the printable medium 10 are respectively oppositely formed to the scanning unit 16 and the printing unit 11.

Moreover, preferably, the printing unit 11 and the scanning unit 16 are simultaneously driven by one carrage motor 19.

Referring to FIGS. 1 and 2, there is shown a multifunctional machine performing a shuttle scanning according to a first preferred embodiment of the present invention.

As shown in the drawings, a path, i.e., from a cassette 23 to an output tray 30 is used for transporting both a document and a printable medium. Between the register rollers 22 located at the transporting path, a base frame 20 is provided to support the document and the printable medium. At the upper and lower parts of the base frame 20, a printing unit 11 and a scanning unit 16 are established, respectively, facing each other. The printing unit 11 is established so that a printhead 14 can face the lower side, and the scanning unit 16 is established so that a scanner head 15 can face the upper side. A slot 21 is formed at a part of the base frame 20 facing the scanner head 15 of the scanning unit 16 in a latitudinal direction of the base frame 20. The width of the slot 21 is adjusted so that the scanner head 15 can perform the scanning, and the length of the slot 21 is adjusted so that the supplied document can be received. Preferably, a protection plate of a transparent material can be inserted into the slot 21.

The printing unit 11 includes the ink-jet printhead 14 performing the printing on the printable medium and it is attached to a transporting belt 12. The transporting belt 12 attaches a carriage motor 19 to a driving pulley 25*b* and a driven pulley 25*a*, and the printing unit 11 can perform the reciprocation perpendicular to the transporting direction of the printable medium 10. Moreover, the printing unit 11 is attached to a guide shaft 13 so that an even interval between the printing unit 11 and the printable medium can be ensured.

The scanning unit 16 includes the scanning head 15 for scanning the data on the document, and it is attached to the transporting belt 28. The transporting belt 28 attaches a driven pulley 25*c* connected to the driving pulley 25*b* by means of a driving force transmitting belt 18 to a driven pulley 25*d*, and the scanning unit 16 can perform the reciprocation perpendicular to the transporting direction of the document. Moreover, the scanning unit 16 is attached to a guide shaft 17 so that an even interval between the scanning unit and the document can be ensured.

The document or the printable medium 10 is stacked in the cassette 23 and the stacked document or the printable medium 10 is successively supplied by the pickup roller 29. On the path of the document and the printable medium 10, a register sensor 24 and the register rollers 22 are provided.

The printing unit 11 and the scanning unit 16 can be connected to the transporting belt so that they are transported simultaneously in the same direction by the carriage motor 19. In other words, referring to FIG. 2A, the printing unit 11 and the scanning unit 16 are connected to the lower parts of the transporting belts 12 and 28, respectively, so that they can be driven in the same direction as the carriage motor 19 operates. In this embodiment, the printing unit 11 and the scanning unit 16 are connected to the lower parts of the transporting belts 12 and 28. It is possible to connect the printing unit 11 and the scanning unit 16 to the upper parts of the transporting belts. Preferably, the printing unit 11 and the scanning unit 16 are away from each other as much as a predetermined distance L.

Moreover, it is possible to connect the printing unit 11 and the scanning unit 16 to the transporting belts so that they are transported in the opposite directions simultaneously by the carriage motor 19. In other words, referring to FIG. 2B, the printing unit 11 and the scanning unit 16 are connected to the lower part of the transporting belt 12 and the upper part of the transporting belt 28, respectively. In this embodiment, the printing unit 11 and the scanning unit 16 are connected to the lower part of the transporting belt 12 and the upper part of the transporting belt 28, respectively. It is possible to connect the printing unit 11 and the scanning unit 16 to the upper part of the transporting belt 12 and the lower part of the transporting belt 28. Moreover, the printing unit 11 and the scanning unit 16 are apart from each other as much as L corresponding to the width where the reciprocation is performed.

The carriage motor 19 is a motor capable of being rotated directly/inversely, such as a stepping motor.

In the embodiment, the axis of the carriage motor 19 is connected to one of the pulleys 25*a* and 25*b* connected to each other by means of the transporting belt 12 for transporting the printing unit 11. It is possible to connect the axis of the carriage motor 19 to one of the pulleys 25*c* and 25*d* connected to each other by means of the transporting belt 28 for transporting the scanning unit 16. In these cases, the transporting belts 12 and 28 should be connected to each other. Here, the transporting belts are connected each other by means of the transmitting belt 18.

Figure 3:
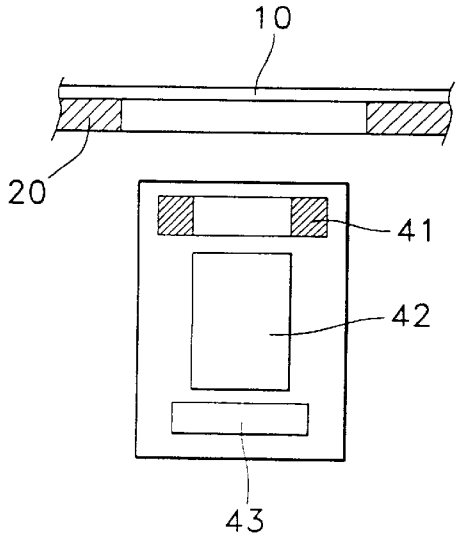
FIG. 3 is a sectional view illustrating the scanning unit according to the present invention.

FIG. 3 is a sectional view illustrating the scanning unit employing the present invention. When a lamp 41 inside of the scanning unit 16 radiates light on the document 10, the light reflected by the surface of the document 10 arrives at an optical sensor 43 through a lens 42, thereby scanning the document.

The operation of the multifunctional machine performing the shuttle scanning according to the first embodiment of the prevent invention, having the above-described structure, will be explained as follows.

First, in the case of scanning the document, the document 10 to be scanned is stacked in the cassette 23, with the surface containing data faced upside. When the document starts to be loaded by a selection key, the transporting motor is driven and the pickup roller 29 is also driven, and thereby the document 10 is successively supplied to the transporting path by the pickup roller 29.

After forming a loop at the register sensor 24 and the register roller 22 for forward edge alignment, the document 10 stops moving when its forward edge arrives at a position corresponding to the slot 21 formed at the base frame by the power switching device by power switching caused by the inversion of the transporting motor.

At this time, as the document 10 is located so that the surface containing data can face downward, the document 10 on the base frame 20 faces the scanner head 15 of the scanning unit 16 and the back side of the document 10 faces the printing unit 11. Accordingly, it is possible to prevent the surface of the document 10 from being contaminated by the printing unit 11. Moreover, in the case that the protection plate 31 made of a transparent material is mounted inside of the slot 21, it is possible to prevent the scanner head 15 of the scanning unit 16 from being contaminated by the alien substance attached to the surface of the document.

When the document 10 stops, the carriage motor 19 such as the stepping motor is driven and the driving pulley 25*b* connected to the axis of the carriage motor 19 is rotated. The rotation of the driving pulley 25*b* is transmitted to the driven pulley 25*c* through the transmitting belt 18. After that, it is transmitted to the driven pulley 25*d* through the transporting belt 28 to which the scanning unit 16 is connected. Moreover, it is transmitted to the driven pulley 25*a* through the transporting belt 12 to which the printing unit 11 is connected. Here, the scanning unit 16 and the printing unit 11 perform a rectilinear movement perpendicular to the transporting direction of the document 10.

According to the rotation of the carriage motor 19, the scanning unit 16 moves along the guide shaft 17 from a home position 27, thereby scanning the data on the document 10. The scanning unit 16 maintains an even interval with the document 10 by the guide shaft 17. After the scanning units scans the document as much as a predetermined width, the carriage motor 19 stops and performs the next operation. At this time, in the case of bidirectional scanning, by driving the transporting motor, the document 10 is transported as much as a predetermined length and the part to be scanned is located to face the slot 21. After that, as the carriage motor 19 is rotated again in the inverse direction according to the control of a central processing unit, the scanning unit 16 moves towards the home position 27 and the data on the document is scanned. On the other hand, in the case of monodirectional scanning, the carriage motor 19 is rotated again in the reverse direction under the control of the central processing unit, and the scanning unit 16 is placed at the home position 27. After that, the document 10 is transported as much as a predetermined length by driving the transporting motor, and the part to be scanned is located to face the slot 21. The above-described process for scanning the document is repeatedly performed until the transportation of the document is completed.

The scanned data is converted into the digital signal and it is transmitted to a memory (not illustrated). In the case that the data is transmitted to the outside, it is transmitted through a line interface and a modem.

The printing operation is explained as follows. First, the printable medium 10 to be printed is stacked in the cassette 23. The transporting motor is driven by the selection key and the pickup roller is also driven. The printable medium 10 is successively supplied to the transporting path by the pickup roller 29.

After the printable medium 10 arrives at an image forming area on the base frame 20 through the control of the position and the forward edge alignment by the register roller 22 and the register sensor 24, the printable medium 10 stops by the power switching device or by the power switching caused by the inversion of the transporting motor.

At this time, the surface of the printable medium 10 stopped at the base frame 20 faces the printing unit 11, and the backside of the printable medium faces the scanning unit 16. As a result, it prevents the image on the printable medium formed by the printing unit 11 from being contaminated by the scanning unit 16.

Figure 2A:
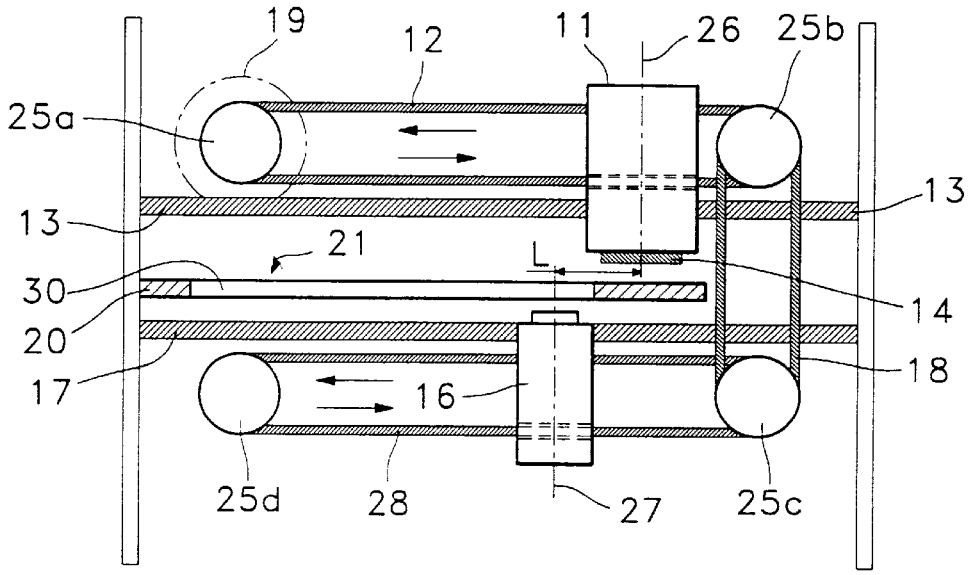
Figure 2B:
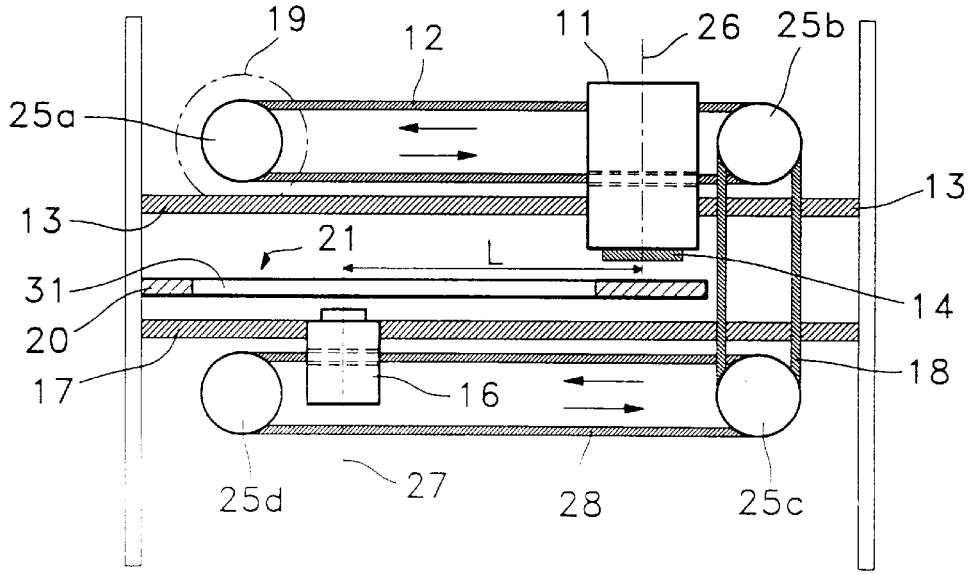

When the printable medium 10 stops, the carriage motor 19 is driven, and the driving pulley 25*b* connected to the axis of the carriage motor 19 is rotated. The rotation of the driving pulley 25*b* is transmitted to the driven pulley 25*a* through the transporting belt 12 to which the printing unit 11 is connected. Here, the printing unit 11 and the scanning unit 16 perform the rectilinear movement perpendicular to the transporting direction of the printable medium 10. The rectilinear movement of the scanning unit 16 and the printing unit 11 can be performed in the same direction, as shown in FIG. 2A. The movement can also be performed in the opposite directions, as shown in FIG. 2B. Here, in the case that the directions of the rectilinear movement are the same, as the scanning unit 16 and the printing unit 11 are apart from each other as much as a predetermined distance L, it prevents the scanning unit 16 from being contaminated by ink injected from the printing unit 11. On the contrary, in the case that the directions of the rectilinear movement are the opposite directions with respect to each other, it is possible to prevent the scanning unit 16 from being contaminated by ink injected from the printing unit 11, by establishing the home positions 27 and 26 of the scanning unit 16 and the printing unit 11 respectively at the ends where the reciprocation movements are performed.

As the carriage motor 19 rotates, the printing unit 11 moves from the home position 26 along the guide shaft 13 and forms the image on the printable medium 10. The printing unit 11 can maintain a predetermined distance with the printable medium by the guide shaft 13. After the printing unit 11 prints data on the printable medium as much as a predetermined width, the carriage motor 19 stops to drive the transporting motor and the part to be scanned is located corresponding to the image forming area by transporting the printable medium. After that, the carriage motor 19 is rotated again in the inverse direction under the control of the central processing unit, and the printing unit 11 moves towards the home position 26, thereby printing on the printable medium. The above-described process is repeatedly performed until the transportation of the printable medium is completed.

As described above, by establishing the scanning unit and the printing unit facing each other, it is possible to prevent the surface of the document from being contaminated by the contact with the printhead of the printing unit, when performing the scanning operation. Moreover, it can prevents the damage of the image on the surface of the document caused by the contact between the surface of the document and the pickup roller, and it is possible to prevent damage to to the image caused by the contact between the scanning unit and the printable medium, when performing the printing operation.

Figure 5:
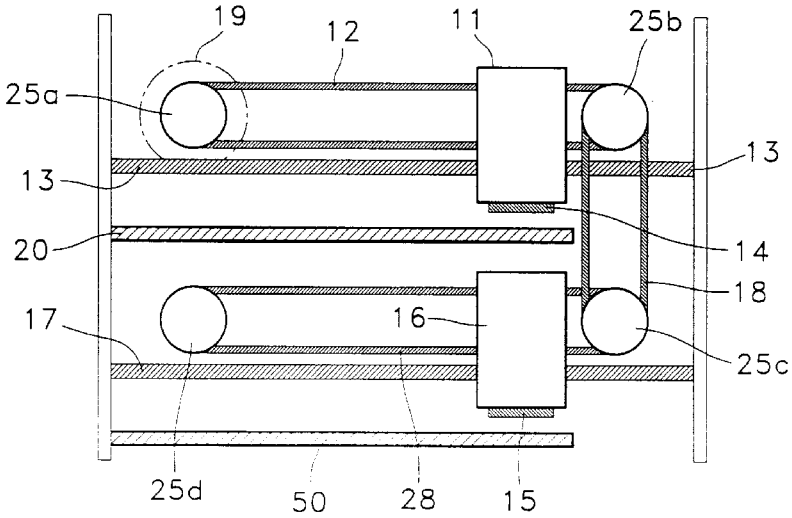
FIG. 5 is a front sectional view illustrating a second embodiment of the multifunctional machine performing the shuttle scanning according to the present invention.

Referring to FIGS. 4 and 5, there is shown the multifunctional machine performing the shuttle scanning according to the second embodiment of the present invention.

As shown in the drawing, the path for transporting the printable medium 10 from the cassette 23 to the output tray 30 is a first direction, and the path for transporting the document 10 from the document stacker 53 to the output tray 51 is a second direction opposite to the first direction, which is separately located at the lower part of the path transporting the printable medium. Though the first direction is indicated opposite to the second direction in the embodiment, it is possible that the first direction and the second direction are the same.

Moreover, a first base frame 20 is located between the register rollers 22 which are provided on the path for transporting the printable medium to support the printable medium 10.

At the upper part of the first base frame 20, the printing unit 11 is connected to the transporting belt 12 so that the printhead 14 can face the lower side. The transporting belt 12 connects the driving pulley 25*b* and the driven pulley 25*a* connected to the axis of the carriage motor 19 and enables the printing unit 11 to be reciprocated perpendicular to the direction for transporting the printable medium 10. Moreover, the printing unit 11 is connected to the guide shaft 13 so that an even interval between the printing unit and the printable medium can be ensured.

A second base frame 50 is located between the register rollers 52 provided on the path for transporting the document 10 to support the document 10. At the upper part of the second base frame 50, the scanning unit 16 is connected to the transporting belt 28 so that the scanning head 15 can face the lower side. The transporting belt 28 connects the driven pulley 25*c* which is connected to the driving pulley 25*b* through the driving force transmitting belt 18 to the driven pulley 25*d*, and enables the scanning unit 16 to be reciprocated perpendicular to the direction for transporting the document 10. Moreover, the scanning unit 16 is connected to the guide shaft 17 so that an even interval between the scanning unit 16 and the document can be ensured. Preferably, the guide shaft 17 is apart from the guide shaft 13 downward and established parallel to the guide shaft 13.

The printable medium 10 is stacked in the cassette 23 and the stacked printable media are successively supplied by the pickup roller 29. On the path for transporting the printable medium, the register sensor 24 and the register rollers 22 are located. Moreover, the document 10 is stacked in the document stacker 53 and the stacked documents 10 are successively supplied by the pickup roller 59 and the friction pad 55 formed at the upper part of the pickup roller 59. On the path for transporting the document, the register sensor 54 and the register rollers 52 are provided.

To drive the printing unit 11 and the scanning unit 16, one carriage motor 19 is used. In the embodiment, the axis of the carriage motor 19 is connected to one of the pulleys 25*a* and 25*b* which are connected each other by the belt 12 which transports the printing unit 11. Also, the axis of the carriage motor 19 can be connected to one of the pulleys 25*c* and 25*d* connected each other by the belt 28 which transports the scanning unit 16. Here, the transporting belts 12 and 28 should be connected. In this embodiment, the transporting belts 12 and 28 are connected by means of the transmitting belt 18. Preferably, the carriage motor is a motor capable of being rotated directly and inversely, such as a stepping motor.

The ratio of traveling speed of the printing unit 11 and the scanning unit 16 can be set as 1:1 by designating the diameters of the driven pulleys 25*a*, 25*b* and 25*c* to be the same. Or, by differently designating the diameters of the driven pulleys 25*a*, 25*b* and 25*c*, the traveling speed of the printing unit 11 and the scanning unit 16 can be set to be a predetermined multiple numbers.

Figure 6:
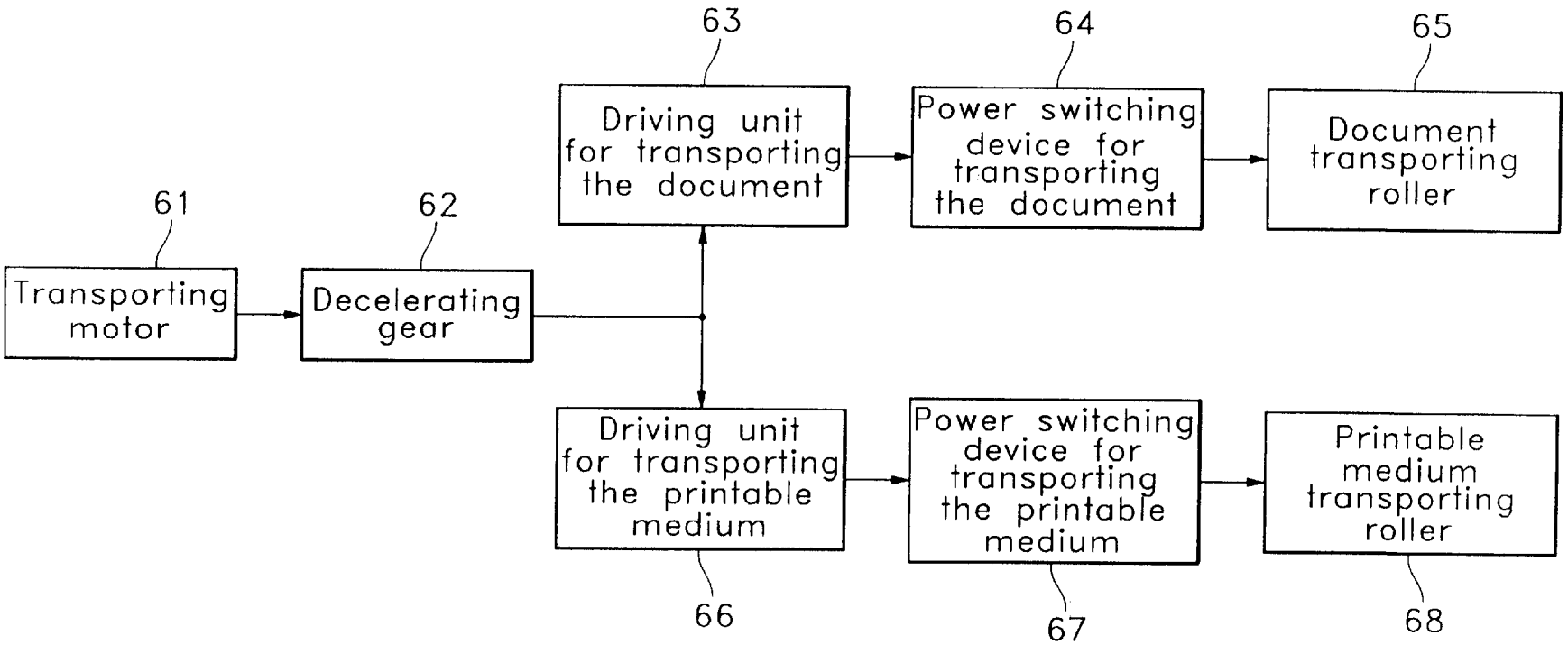
FIG. 6 is a block diagram illustrating the process for transmitting power which transports a document and a printable medium according to the present invention.

Referring to FIG. 6, a transporting motor 61 is used for transporting the document and the printable medium, according to the present invention. The driving force generated by the transporting motor 61 is decelerated through the decelerating gear 62, and the decelerated driving force is transmitted to the driving unit 63 for transporting the document and the driving unit 66 for transporting the printable medium, respectively. The driving unit 63 for transporting the document and the driving unit 66 for transporting the printable medium which receive the driving force control the power switching device 64 for transporting the document and the power switching device 67 for transporting the printable medium, respectively, and they transmit the power to the document transporting roller 65 and the printable medium transporting roller 68, respectively. Accordingly, the driving force of the transporting motor 61 can be supplied to the transporting rollers 65 and 68, separately or simultaneously.

At this time, as illustrated in FIG. 4, the document transporting roller 65 indicates the pickup roller 59 and the register rollers 52, and the printable medium transporting roller 68 indicates the pickup roller 29 and the register rollers 22.

The operation of the multifunctional machine performing the shuttle scanning according to the second embodiment according to the present invention, having the above-described structure, will be explained as follows.

The scanning operation will be described first. When the documents 10 are stacked in the document stacker 53 and the document is loaded by the selection key, the transporting motor 61 is driven. The driving force generated by the transporting motor 61 is decelerated through the decelerating gear 62, and the decelerated driving force is transmitted respectively to the driving unit 63 for transporting the document and the driving unit 66 for transporting the printable medium. After that, the driving unit 63 for transporting the document which receives the driving force turns on the power switching device for transporting the document, and drives the document pickup roller 59 and the register roller 52. At this time, as the surface of the document 10 is contacted with the friction pad 55 and the backside of the document 10 is contacted with the pickup roller 59, the surface of the document 10 is not damaged by the pickup roller 59.

After forming the loop at the register sensor 54 and the register roller 52 for forward edge alignment, the forward edge of the document 10 stops at the image scanning area on the second base frame 50 by the power switching device 64 for transporting the document or the power switching by the inversion of the transporting motor 61.

When the document 10 stops, the carriage motor 19 is driven, and the driving pulley 25*b* connected to the axis of the carriage motor 19 is rotated. The rotation of the driving pulley 25*b* is transmitted to the driven pulley 25*c* through the transmitting belt 18, and to the driven pulley 25*d* through the transporting belt 28 connected to the scanning unit 16. Here, the scanning unit 16 performs the rectilinear movement perpendicular to the transporting direction of the document 10.

At this time, the scanning unit 16 moves along the guide shaft 17 and scans data on the document 10. The scanning unit 16 can maintain an even interval with the document by the guide shaft 17. The above-described scanning is repeatedly performed until the transportation of the document is finished.

The scanned data is converted into the digital signal and transmitted to the memory, and it is transmitted to the outside through the line interface and the modem.

Now, the printing operation is explained as follows. First, when the printable medium 10 is stacked in the cassette 23 and the transporting motor 61 is driven by the selection key, the driving force generated by the transporting motor 61 is decelerated through the decelerating gear 62. The decelerated driving force is transmitted respectively to the driving units 63 and 66 for transporting the printable medium. The driving unit 66 for transporting the printable medium which receives the driving force turns on the power switching device 67 for transporting the printable medium and drives the printable medium pickup roller 29 and the register roller 22.

After arriving at the image forming area on the first base frame 20 through the forward edge alignment and the control of the position by the register roller 22 and the register sensor 24, the printable medium 10 stops by the power switching caused by the inversion of the transporting motor 61 or the power switching device 67.

When the printable medium 10 stops, the carriage motor 19 is driven simultaneously and the driving pulley 25*b* connected to the axis of the carriage motor 19 is rotated. The rotation of the driving pulley 25*b* is transmitted to the driven pulley 25*a* through the transporting belt 12 to which the printing unit 11 is connected. Here, the printing unit 11 performs the rectilinear movement perpendicular to the transporting direction of the printable medium 10.

As the carriage motor 19 rotates, the printing unit 11 moves along the guide shaft 13 and forms the image on the printable medium 10. The printing unit 11 can maintain an even interval with the printable medium by means of the guide shaft 13. The above-described printing operation can repeatedly be performed until the transportation is completed.

In the present invention, it is possible to print the stored data which is scanned, by adding the memory capable of temporarily storing the scanned data. Accordingly, it provides a function of copying the document which can perform the printing operation immediately after the predetermined line of the document is scanned. When performing the function of copying the document, the length of the document which is scanned once by the scanning unit 16 through the reciprocation and the length of the printable medium which is printed once by the printing unit 11 through the reciprocation can be set to be same or to be multiple numbers.

The present invention relates to a multifunctional machine, and particularly to a multifunctional machine which prevents the contamination caused by the contact of a document and a printhead, by placing the printhead to face a base frame supporting a printable medium and placing a scanner to face the base frame supporting the document.

Further, the present invention relates to a multifunctional machine capable of simplifying the structure and reducing the manufacturing costs, by sharing the base frame for supporting the printable medium and the document and by moving the printhead and the scanner using one driving motor.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A multifunctional machine having different paths for transporting a document and a printable medium, the machine comprising:

a first base frame which is located at a path for transporting said printable medium and supports said printable medium;

a second base frame which is located at a path for transporting said document and supports said document;

supplying means for supplying said document onto said second base frame, said supplying means including a single pickup roller and a friction pad facing said pickup roller, said friction pad having a flat surface which is in contact with a recordable surface of said document;

printing means which is located at an upper part of said first base frame and prints on said printable medium by reciprocating on the printable medium; and document scanning means which is located at an upper part of said second base frame and scans said document by reciprocating on said document in a direction perpendicular to a transporting direction of said document; wherein said document scanning means and said printing means are driven by a single driving source in the same direction.

2. The multifunctional machine of claim 1, said document scanning means and said printing means each receiving a driving force from said driving source through a belt.

3. The multifunctional machine of claim 1, further comprising:

a first guide shaft for guiding the reciprocation of said printing means; and a second guide shaft for guiding the reciprocation of said scanning means, said second guide shaft being located apart from and parallel to said first guide shaft.

4. The multifunctional machine of claim 1, further comprising:

power means for providing power to transport said document and said printable medium in the same direction.

5. The multifunctional machine of claim 4, wherein said power means comprises:

a transporting motor for generating a driving force;

a decelerating gear for decelerating the driving force generated by said transporting motor;

driving units for transporting said document and said printable medium, and for transmitting the decelerated driving force to a document transporting roller and a printable medium transporting roller, respectively; and power switching devices for transporting said document and said printable medium, and for controlling delivery of the driving force to said document transporting roller and said printable medium transporting roller in accordance with control of said driving units.

6. A multifunctional machine, comprising:

a first base frame for supporting a printable medium;

a second base frame for supporting a document;

supplying means for supplying said document onto said second base frame, said supplying means including a single pickup roller and a friction pad facing said pickup roller, said friction pad having a flat surface which is in contact with a recordable surface of said document;

printing means which is located to face said first base frame and prints data on said printable medium by performing a reciprocation on the printable medium located at said first base frame perpendicular to a direction in which said printable medium is transported;

document scanning means which is located to face said second base frame and scans said document by performing a reciprocation on said document located at said second base frame perpendicular to a direction in which said document is transported;

driving force generating means for generating a driving force to drive said document scanning means and said printing means; and driving force transmitting means for transmitting the driving force generated by said driving force generating means to said printing means and said document scanning means;

said driving force generating means being connected to said driving force transmitting means for driving said printing means and said document scanning means in the same direction.

7. The multifunctional machine of claim 6, further comprising:

a first guide shaft for guiding the reciprocation of said printing means; and a second guide shaft for guiding the reciprocation of said document scanning means, said second guide shaft being located apart from and parallel to said first guide shaft.

8. The multifunctional machine of claim 6, said driving force transmitting means comprising a single driving source for transmitting the driving force to said scanning means and to said printing means so that they have the same traveling speed.

9. The multifunctional machine of claim 6, said driving force transmitting means including separate driving sources for transmitting the driving force separately to said scanning means and to said printing means so that they have different traveling speeds.

10. The multifunctional machine of claim 6, said driving force transmitting means comprising:

a driving pulley connected to said driving force generating means;

a first driven pulley connected to said driving pulley through one of a first wire and an endless belt on which said printing means is mounted;

a second driven pulley connected to said first driven pulley through one of a second wire and an endless belt; and a third driven pulley connected to said second driven pulley through one of a third wire and an endless belt on which said document scanning means is mounted.

11. The multifunctional machine of claim 6, said driving force generating means including a stepping motor.

12. The multifunctional machine of claim 6, wherein said first base frame and second base frame are shared as a common base frame and the path for transporting said document and printable medium is the same.

13. The multifunctional machine of claim 12, wherein said printing means is located at the upper part of said common base frame and said scanning means is located at the lower part of said common base frame, facing each other.

14. A multifunctional machine having a function for scanning a document to be transported and a function for printing on a printable medium to be transported, comprising:

document scanning means for scanning said document by reciprocating in a direction perpendicular to a direction in which said document is transported;

printing means for printing said printable medium by reciprocating in a direction perpendicular to a direction in which said printable medium is transported; and first and second driving source means for separately driving said document scanning means and said printing means, respectively, so that said document scanning means and said printing means are moved at different, respective speeds;

said document scanning means and said printing means being separated from each other by a predetermined distance perpendicular to said transporting direction and said reciprocating direction, respectively, said document scanning means and said printing means reciprocally moving in the same direction.

15. The multifunctional machine of claim 14, said document scanning means and printing means being respectively opposite and a path for transporting both said document and printable medium being formed between said document scanning means and printing means.

16. The multifunctional machine of claim 15, the path for transporting both said document and printable medium being the same path.

17. The multifunctional machine of claim 14, wherein a path for transporting said document and a path for transporting said printable medium are oppositely formed relative to said document scanning means and said printing means, respectively.

* * * * *